US005418320A

United States Patent [19]

Higashi

[11] Patent Number: 5,418,320

[45] Date of Patent: May 23, 1995

[54] ELECTRONIC MUSICAL INSTRUMENT CONNECTABLE WITH A PLURALITY OF TONE GENERATING SUBSTRATES

[75] Inventor: Iwao Higashi, Shimonoseki, Japan

[73] Assignee: Yamaha Corporation, Japan

[21] Appl. No.: 149,047

[22] Filed: Nov. 8, 1993

[30] Foreign Application Priority Data

Nov. 11, 1992 [JP] Japan ..... 4-300830

[51] Int. Cl.[6] ..... G10H 1/36; G10H 1/42

[52] U.S. Cl. ..... 84/602; 84/609; 84/610; 84/611; 84/DIG. 12

[58] Field of Search ..... 84/601, 602, 609–614, 84/634–638, DIG. 12, DIG. 22

[56] References Cited

U.S. PATENT DOCUMENTS 4,250,788 2/1981 Franz et al. ..... 84/602 X
4,922,794 5/1990 Shibukawa ..... 84/601
5,020,410 6/1991 Sasaki .

*Primary Examiner*—Stanley J. Witkowski
*Attorney, Agent, or Firm*—Graham & James

[57] ABSTRACT

An electronic musical instrument includes a plurality of tone generating substrates, a connection portion, a channel detector and a channel assigner. Each of the plurality of tone generating substrates has at least one tone generation channel which generates a tone signal in response to assignment information input thereto. The connection portion has a plurality of connection slots with which the tone generating substrates are connected. The channel detector detects a number of all the tone generation channels of the tone generating substrates connected with the connection portion. The channel assigner, responsive to performance information input thereto, assigns the performance information as assignment information to one of the tone generation channels detected by the channel detector. The assigned tone generation channel generates a tone signal in accordance with the performance information.

9 Claims, 4 Drawing Sheets

FIG. 3

PN = 14

| MEMORY AREA NUMBER | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| TONE GENERATING SUBSTRATE NUMBER | 1 | 1 | 1 | 1 | 2 | 2 | 3 | 3 | 4 | 4 | 5 | 5 | 5 | 5 |
| TONE GENERATION CHANNEL NUMBER | 1 | 2 | 3 | 4 | 1 | 2 | 1 | 2 | 1 | 2 | 1 | 2. | 3 | 4 |
| CONTENTS OF EACH TONE GENERATION CHANNEL | 63 | 52 | 121 | 49 | 12 | 101 | 103 | 98 | 65 | 32 | 70 | 65 | 31 | 90 |

ELECTRONIC MUSICAL INSTRUMENT CONNECTABLE WITH A PLURALITY OF TONE GENERATING SUBSTRATES

BACKGROUND OF THE INVENTION

This invention relates to an electronic musical instrument, and more particularly to an electronic musical instrument which is capable of arbitrarily establishing a number of the tone generation channels thereof and types of the tone generation methods thereof.

There are conventional electronic musical instruments each having a plurality of built-in tone synthesizing circuits (tone generators). In each of the built-in tone synthesizing circuits, a number of the tone generation channels thereof is fixed. The number represents the maximum number of the tone signals which are concurrently generated by a built-in tone synthesizing circuit. Therefore, the maximum number of the tone signals which a conventional electronic musical instrument can concurrently generate is fixed.

In performing a tune on the conventional electronic musical instrument, there is a case in which more tone generation channels than the maximum number are necessary to concurrently generate more tone signals than the maximum number. In such a case, in order to get the more tone generation channels, another electronic musical instrument is coupled or connected with the electronic musical instrument on which a player performs a tune, using a MIDI (Musical Instrument Digital Interface) cable. Other electronic musical instruments are used only to increase the maximum number of the tone signals which are concurrently generated.

However, the above conventional method, using plural electronic musical instruments to perform a tune, has shortcomings as follows. First, tone colors of the tone signals generated by one of the electronic musical instruments often unfit for tone colors of the tone signals generated by the other. Second, it is difficult to efficiently assign plural tone generation information to the plural electronic musical instruments connected with each other using a MIDI cable. Third, since the conventional method use only the tone synthesizing circuits from among all the devices of the other electronic musical instrument in order to get more tone generation channels, the conventional method wastes other devices like a keyboard, a switch-panel and so on.

SUMMARY OF THE INVENTION

Therefore, it is an object of the present invention to provide an electronic musical instrument which is capable of increasing and decreasing a number of the tone generators (tone generating substrates) thereof efficiently, in response to a tune to be performed, so as to increase and decrease the maximum number of the tone signals which are concurrently generated thereby.

In order to achieve the above-mentioned object, an electronic musical instrument according to the present invention comprises a plurality of tone generating substrates each having at least one tone generation channel which generates a tone signal in response to assignment information input thereto, a connection portion having a plurality of connection slots with which the tone generating substrates are connected, a channel detector detecting a number of all the tone generation channels of the tone generating substrates connected with the connection portion, a channel assigner, responsive to tone generation information input thereto, assigning the tone generation information as assignment information to one of the tone generation channels detected by the channel detector and a controller controlling the assigned tone generation channel so that the assigned tone generation channel generates a tone signal in accordance with the tone generation information.

Before performing a tune, the tone generating substrates of an arbitrary number are connected or coupled with the connection portion of the electronic musical instrument so as to get more tone generation channels than those of a number necessary to perform the tune. Then, a number of all the tone generation channels of the connected tone generating substrates are automatically detected by the channel detector. When a player performs the tune on the electronic musical instrument, plural performance information corresponding to the player's performances are automatically assigned to the detected tone generation channels so that the assigned tone generation channels respectively generate tone signals corresponding to the assigned performance information.

Thus, since the player can set up desirable tone generating substrates by an arbitrary number for the electronic musical instrument, the player can arbitrarily establish a number of the tone generation channels and types of the tone generation methods for the electronic musical instrument without wasting any devices. Further, even after newly connecting additional tone generating substrates with the connection portion, the player do not need to input a number of all the tone generation channels usable for the electronic musical instrument thereto and to reset the electronic musical instrument.

Now, the preferred embodiment of the present invention will be described with reference to the accompanying drawings.

BRIEF DESCRIPTION OF THE PRESENT INVENTION

In the drawings:

FIG. 3 is a graphic representation showing a storing state of an assignment memory formed in the RAM 13 shown in FIG. 1;

DETAILED DESCRIPTION OF THE PREFERRED EMBODIMENT

Figure 1:
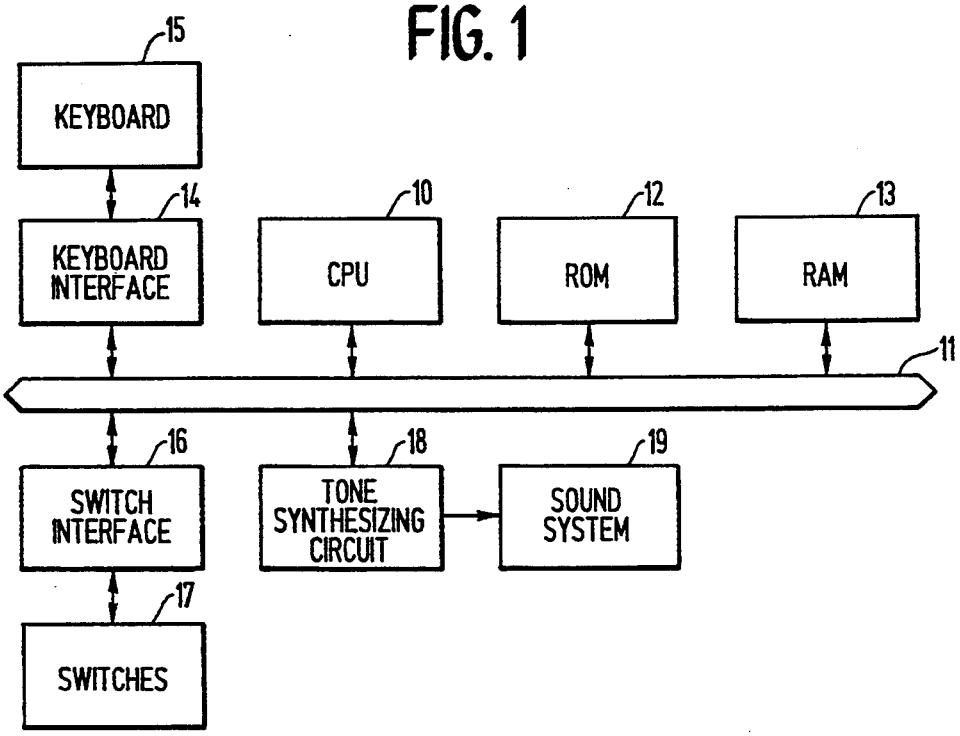
FIG. 1 is a block diagram of the overall structure of an electronic musical instrument in accordance with the present invention.
Figure 2:
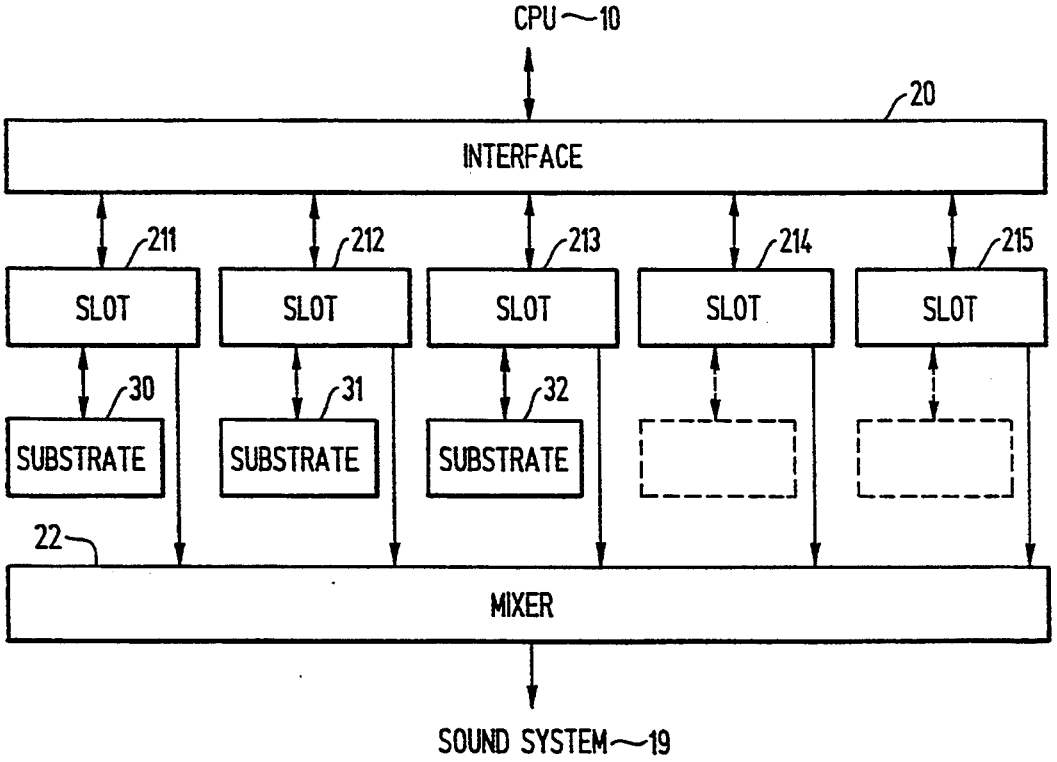
FIG. 2 is a block diagram of the tone synthesizing circuit 18 shown in FIG. 1.

FIG. 1 shows a block diagram illustrating the overall structure of an electronic musical instrument in accordance with the present invention. The electronic musical instrument has a keyboard 15, a tone synthesizing circuit 18 and a sound system 19. The tone synthesizing circuit 18 synthesizes and outputs tone signals in digital in response to player's performances on the keyboard 15. The synthesized tone signals in digital are converted into those in analog by a Digital/Analog converter in the sound system 19. Then, the sound system 19 amplifies the tone signals and generates musical tones corresponding to the amplified tone signals. As shown in FIG. 2, the tone synthesizing circuit 18 has five connection slots 211 to 215 in order to insert desirable tone generating substrates thereto by a desirable number less than six. The player can use all the tone generation channels of the connected tone generating substrates to synthesize desirable tone signals in performing a tune on the electronic musical instrument.

In FIG. 1, a CPU (Central Processing Unite) 10 is coupled or connected with a ROM (Read Only Memory) 12, a RAM (Random Access Memory) 13, a keyboard interface 14, a switch interface 16 and the tone synthesizing circuit 18 through a bus 11. The keyboard 15 is coupled with the bus 11 through the keyboard interface 14. A key-on signal, a keycode signal and a touch signal generated by the keyboard 15 in response to a key depression by the player are sent to the CPU 10 through the keyboard interface 14 and the bus 11. Switches 17 is coupled with the switch interface 16 and includes tone-color selection switches. The ROM 12 stores programs to control the operation of the electronic musical instrument. The RAM 13 establishes various resisters therein to store various data provided in response to the player's performance.

FIG. 2 shows a block diagram of the tone synthesizing circuit 18. An interface 20 are coupled with the five connection slot 211 to 215 and the bus 11. Tone generating substrates 30, 31 and 32 each having tone generation channels of a predetermined number are coupled or connected with the connection slots 211,212 and 213 respectively. Each of the tone generating substrates 30, 31 and 32 contains a board having a tone generating circuit and peripheral circuits thereon and is inserted into the connection slots 211, 212 and 213 fixed to a body of the electronic musical instrument. Each board and each connection slot have terminals for an electric power, an address bus and a data bus. When inserting the board to the connection slot, the terminals of them are connected with each other. The interface 20 assigns various signals sent by the CPU 10, such as a key-on signal, a keycode signal and so on, to a certain number tone generation channel of one designated by the CPU 10 among the tone generating substrates 30, 31 and 32. The interface 20 further functions to control timing of the time-sharing manner of the tone generating circuit in each of the tone generating substrates 30, 31 and 32. The connection slots 211 to 215 are also coupled with a mixer 22. The mixer 22 adds tone signals together, which are output from the tone generating substrates 30, 31 and 32 in the time-sharing manners, in response to output-timing of each of the tone generating substrates 30, 31 and 32. The added (mixed) tone signals are output to the sound system 19. Each of the connection slots 211 to 215 has a switch (not shown in FIGS. 1 to 5) which detects the insertion of a tone generating substrate into a connection slot. The insertion is informed the CPU 10 of through the interface 20.

An arbitrary tone synthesizing method are acceptable as that for the tone generating circuit of a tone generating substrate to be connected with one of the connection slots 211 to 215. However, each of the tone generating substrates should be regularized so as to, when data representing a tone color, a tone pitch and a tone volume of a musical tone to be synthesized is input thereto, synthesize a tone signal corresponding to the data. When the tone synthesizing methods of the tone generating substrates are different from each other, plural tone generating substrates can not generate tone signals having the same tone color. Even in such a case, it is better to provide a regularized designation method on the tone color by assigning a common name to tone colors similar to each other among the tone colors of the plural tone generating substrates. The tone generating substrates connectable with the connection slots 211 to 215 are composed of four kinds of those, which respectively have one, two, four and eight tone generation channels. Therefore, according to a tune to be performed, the player should select tone generating substrates each having a desirable number tone generation channels and insert the selected tone generating substrates into the connection slots. The terminal of each tone generating substrate have two signal lines which output a signal of two bits representing a number of the tone generation channels of the tone generating substrate. Therefore, based on the two-bit signals output from the connected tone generating substrates, the electronic musical instrument decides which of one, two, four and eight is the number of the tone generation channels of each tone generating substrates and thereby detects a number of all the tone generation channels of the connected tone generating substrates.

FIG. 3 shows a table explaining an assigning state of an assignment memory formed in RAM 13. The assignment memory can have forty memory areas corresponding to the maximum number ($40 = 5 \times 8$) tone generation channels of five tone generating substrates inserted into the connection slots 211 to 215. Each of the memory areas is composed of a first area storing a board-number of the corresponding tone generating substrate, a second area storing a channel-number of the corresponding one among the tone generation channels of the corresponding tone generating substrate and a third area storing assignment information such as a keycode.

In response to turning on the power switch after connecting desirable tone generating substrates with the connection slots 211 to 215, the CPU 10 detects a number of all the tone generation channels of the connected tone generating substrates based on the two bit signal output therefrom and then establishes memory areas of the same number as the detected number in the assignment memory. FIG. 3 shows an example in which five tone generating substrates are connected with the connection slots 211 to 215 and the number of all the tone generation channels thereof is fourteen.

Figure 4:
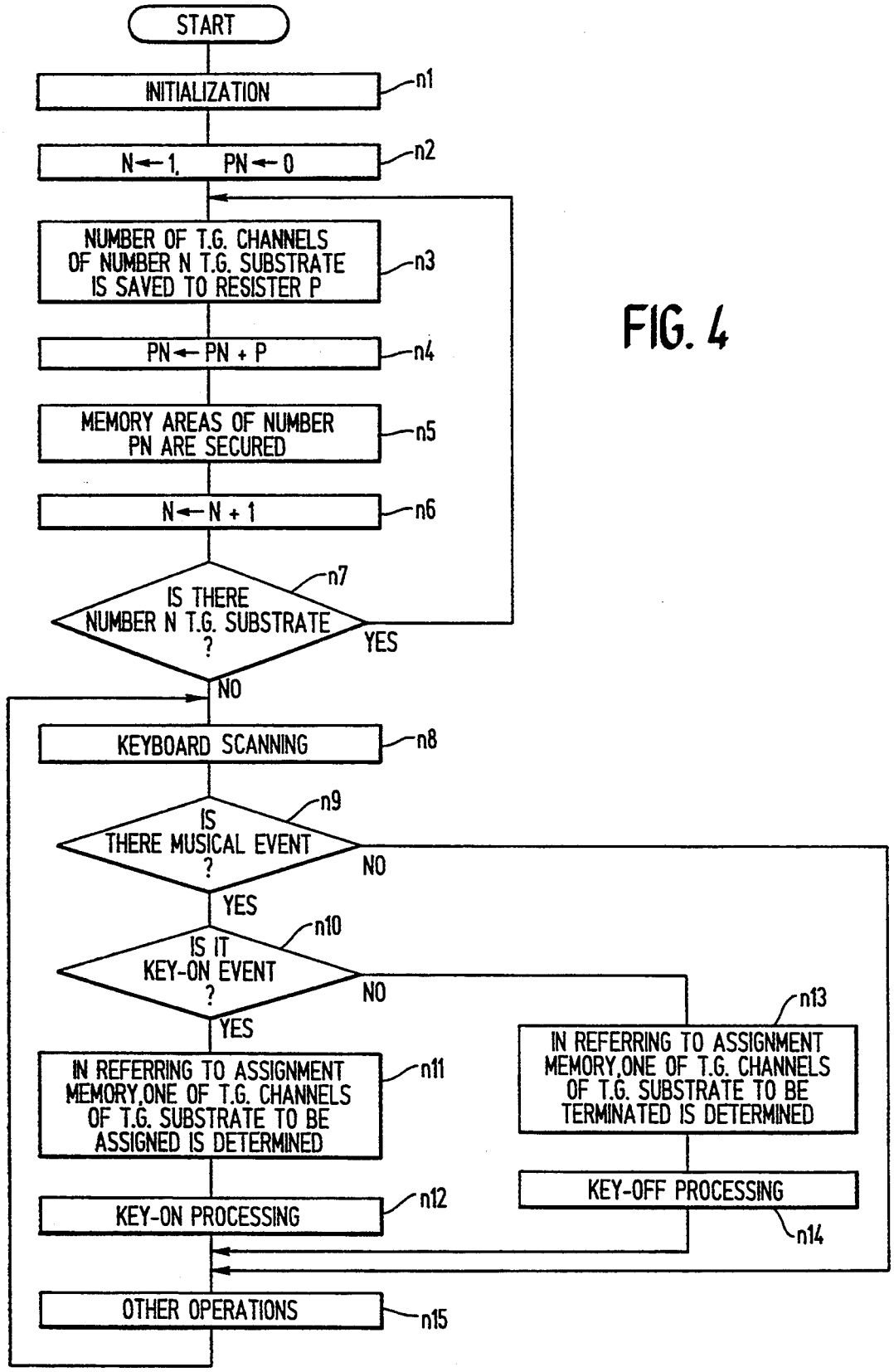
FIG. 4 is a flowchart explaining an operation of the electronic musical instrument shown in FIG. 1.

FIG. 4 shows a flowchart explaining an operation of the electronic musical instrument. It is postulated that tone generating substrates are connected with the connection slots 211 to 215 in turn without skipping any slot. At step n1, in response to turning on the power switch after connecting desirable tone generating substrates with the connection slots 211 to 215, the electronic musical instrument is initialized. "1" is saved to a slot pointer N representing a connection-slot number, and "0" is saved to a tone generable number resister PN storing a number of tone generation channels, respectively at step n2. At steps n3 to n7, the number of all the tone generation channels of the connected tone generating substrates is detected. That is, a number of the tone generation channels of the tone generating substrate connected with the connection slot designated by the slot pointer N is saved to a resister P at step n3. The contents of the resister P is added to the contents of the resister PN at step n4. Then, memory areas of a number corresponding to the contents of the resister PN are secured in the assignment memory at step n5, and the slot pointer N is incremented at step n6. At step n7, when there is a tone generating substrate connected with the connection slot designated by the slot pointer N, the operations of step n3 to n7 is repeated for that tone generating substrate. When there are no tone generating substrate at step n7, it is decided that the number of all the tone generation channels of the connected tone generating substrates has been detected and that the contents of the tone generable resister PN provides the number.

At step n8, the keyboard 15 is scanned through the interface 14. If there is a musical event at step n9, it is decided which of a key-on event and a key-off event the musical event is, at step n10. If the musical event is a key-on event, one of the connected tone generating substrates and one of the tone generation channels thereof to which the performance information corresponding to the key-on event should be assigned are determined in referring to the assignment memory, and so the performance information ( a keycode ) is stored at the memory area corresponding to the determined tone generation channel, at step n11. Then, the performance information is sent to the tone synthesizing circuit 18, in which a key-on processing corresponding thereto is performed so as to generate a tone signal having a tone pitch corresponding to the keycode and a tone color determined by the corresponding tone generating substrate, at step n12. On the other hand, if the musical event is a key-off event at step n9, one of the connected tone generating substrates and one of the tone generation channels thereof whose tone generation should be terminated are determined in referring to the assignment memory, at step n13. Then, a signal representing the termination of the tone generation is sent to the tone synthesizing circuit 18, in which a key-off processing corresponding to the key-off event is performed so as to reset the contents (a keycode) of the memory area corresponding the determined tone generation channel, at step n14.

At step n15, the other operations including a master-volume operation for determining the entire tone volume of the tone signals are performed. After that, the control of the CPU returns to step n8, and the operations of steps n8 to n15 are repeated.

Figure 5:
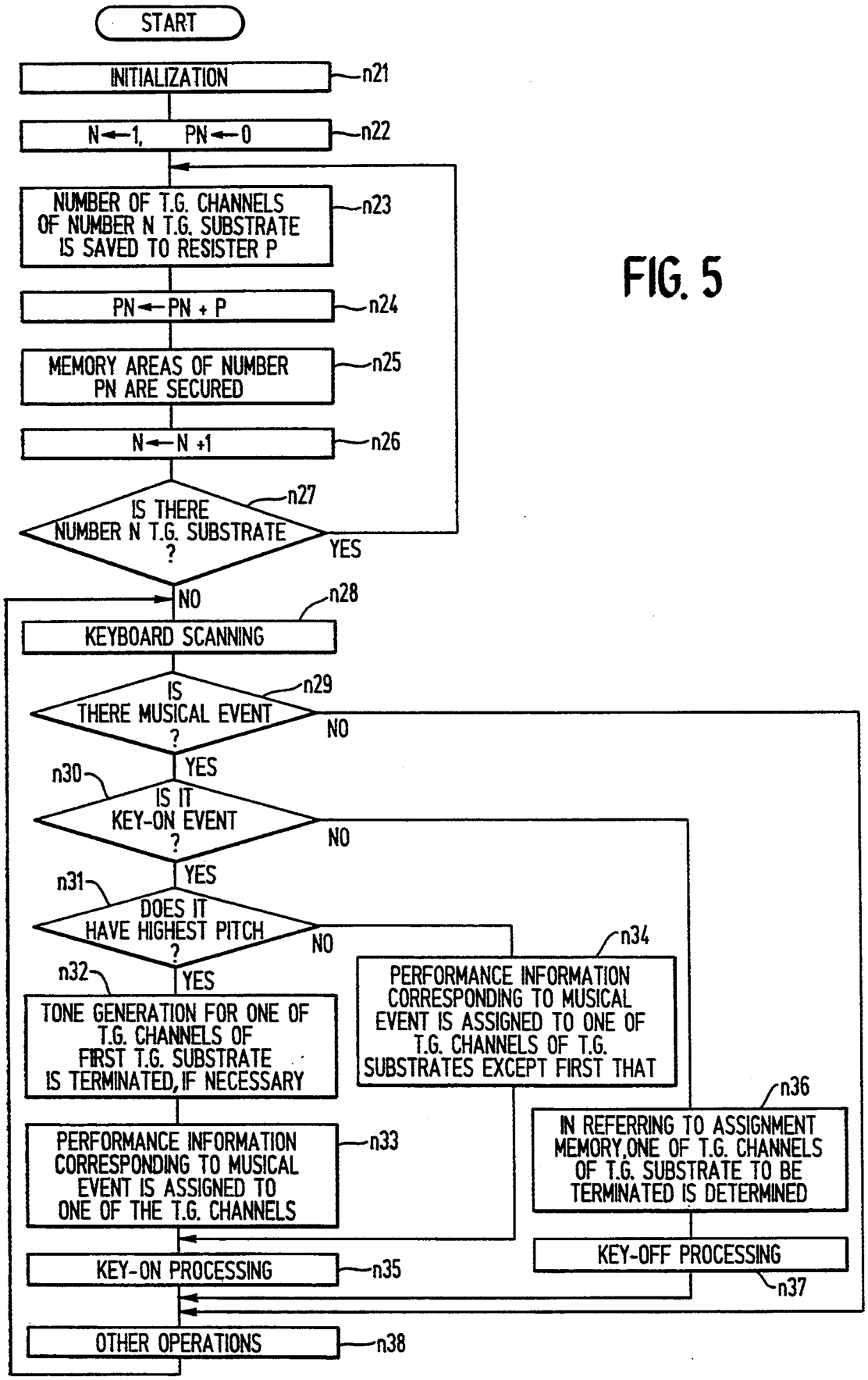
FIG. 5 is a flowchart explaining another operation of the electronic musical instrument shown in FIG. 1.

FIG. 5 shows a flowchart explaining another operation of the electronic musical instrument. In this operation, performance information (a musical event) for a melody is assigned to one of the tone generation channels of the tone generation substrate connected with the first connection slot 211. When a plurality of musical events concurrently arise, one having the highest tone pitch among the plurality of musical events is identified as a musical event for the melody. By adopting that assignment method, it is possible that all the tone signals for the melody have a specific tone color corresponding to the tone generating substrate of the first connection slot 211. By the way, if the criterion of the identification of musical events is changed from a musical event having the highest tone pitch to musical events for an accompaniment and a rhythm, tone generating substrates having tone generators for the accompaniment and the rhythm are connected with specific connection slots respectively and musical events identified as those for the accompaniment and the rhythm are assigned to the tone generating substrates of the specific connection slots.

The contents of steps n21 to n27 are the same as those of steps n1 to n7 in FIG. 4. That is, at step n21, in response to turning on the power switch after connecting desirable tone generating substrates with the connection slots 211 to 215, the electronic musical instrument is initialized. "1" is saved to a slot pointer N representing a connection-slot number, and "0" is saved to a tone generable number resister PN storing a number of tone generation channels, respectively at step n22. At steps n23 to n27, the number of all the tone generation channels of the connected tone generating substrates is detected. That is, a number of the tone generation channels of the tone generating substrate connected with the connection slot designated by the slot pointer N is saved to a resister P at step n23. The contents of the resister P is added to the contents of the resister PN at step 24. Then, memory areas of a number corresponding to the contents of the resister PN are secured in the assignment memory at step n25, and the slot pointer N is incremented at step n26. At step n27, when there is a tone generating substrate connected with the connection slot designated by the slot pointer N, the operations of step n23 to 27 is repeated for that tone generating substrate. When there are no tone generating substrate at step n27, it is decided that the number of all the tone generation channels of the connected tone generating substrates has been detected and that the contents of the tone generable resister PN provides the number. Then, subsequent steps to generate tone signals are performed in turn.

At step n28, the keyboard 15 is scanned through the interface 14. If there is a musical event at step n29, it is decided which of a key-on event and a key-off event the musical event is, at steps n30. If the musical event is a key-on event, it is decided whether the musical event is one having the highest tone pitch among the plural key-on events generated concurrently, at step 31. If the musical event is the key-on event having the highest tone pitch, the key-on event is assigned to one of the tone generation channels of the first tone generating substrate connected with the first connection slot 211, and the performance information (a keycode) corresponding to the key-event is stored at the memory area corresponding to the assigned tone generation channel as assignment information, at step 33. At that time, if all the tone generation channels are generating tone signals respectively, the tone generation of one of the tone generation channels is terminated before assigning the key-on event thereto, at step 32. If the musical event is not a key-on event having the highest tone pitch, it is decided which of the tone generation channels of the connected tone generating substrates except the tone generating substrate for the melody the musical event should be assigned to in referring the contents of the assignment memory, and so the performance information corresponding to the musical event is stored at the memory area corresponding to the decided tone generation channel, at step 34. Then, the performance information is sent to the tone synthesizing circuit 18, in which a key-on processing for generating a tone signal corresponding to the performance information is performed at step 35. On the other hand, if the musical event is a key-off event at step n30, one of all the tone generation channels of the connected tone generating substrates whose tone generation should be terminated are determined in referring to the assignment memory, at step n36. Then, a signal representing the termination of the tone generation is sent to the tone synthesizing circuit 18, in which a key-off processing corresponding to the key-off event is performed so as to reset the contents (a keycode) of the memory area corresponding the determined tone generation channel, at step n37.

At step n38, the other operations including a master-volume operation for determining the entire tone volume of tone signals are performed. After that, the control of the CPU 10 returns to step n28, and the operations of steps n28 to 38 are repeated.

In the above-mentioned embodiment, the detection of the number of all the tone generation channels of the connected tone generating substrates is performed when turning on the power switch, but it should be obvious that the present invention may interrupt in response to an insertion of a tone generating substrate into a connection slot and do an initial operation for the assignment memory over again during the interruption. The embodiment does not explain a case in which one of the connected tone generating substrates is pulled out, but it should be obvious that the present invention may detect the pull of a tone generating substrate and then perform an operation for generating an error signal to inform a player thereof or for doings the above initial operation over again. It should be obvious that the number of the connection slots may be a number other than the number, five, of the embodiment.

Further, it is sufficient, so as to generate a desirable tone signal with each tone generating substrate, that the tone generating substrate functions to receive at least data representing a tone pitch and a tone volume and to synthesize a tone signal corresponding to the data. But, it should be obvious that The CPU 10 may read out a control program stored by the ROM 12 and then enable the player to control tone generation parameters of the tone generating substrate in accordance with the read control program.

What is claimed is:

1. An electronic musical instrument connectable with a plurality of tone generating substrates comprising:

a plurality of tone generating substrates each having at least one tone generation channel which generates a tone signal in response to assignment information input thereto;

a connection portion having a plurality of connection slots with which the tone generating substrates are connected;

a channel number detector detecting numbers of the tone generation channels of the tone generating substrates connected with the connection portion; and a channel assigner, responsive to performance information input thereto, assigning the performance information as assignment information to the detected tone generation channels wherein the assigned tone generation channel generates a tone signal in accordance with the performance information.

2. An electronic musical instrument as defined in claim 1 further comprising:

a keyboard generating performance information in response to a player's performance thereto, wherein the channel assigner assigns the generated performance information to one of the detected tone generation channels in consideration of a state of previous assignment for the detected tone generation channels.

3. An electronic musical instrument as defined in claim 1, wherein each of the tone generating substrates generates a signal representing a number of the tone generation channels thereof, and the channel number detector detects the numbers of the tone generation channels based on the signals generated by the tone generating substrates.

4. An electronic musical instrument as defined in claim 1, wherein the tone generating substrates have one for a melody, one for an accompaniment and one for an rhythm, wherein the channel assigner assigns the performance information to one of the tone generation channels in accordance with a predetermined criterion.

5. An electronic musical instrument as defined in claim 4, wherein, when there are concurrently a plurality of performance information, one of the highest pitch among the plurality of performance information is assigned to a tone generating substrate for the melody.

6. An electronic musical instrument as defined in claim 1 further comprising:

a mixer mixing tone signals concurrently output from the tone generation channels;

a converter converting the mixed tone signals in digital to those in analog;

a sound system generating tones based on the converted tone signals.

7. An electronic musical instrument as defined in claim 1 further comprising:

assignment memory having a plurality of memory areas respectively corresponding to the tone generation channels, each of the memory areas storing data representing a substrate number of a corresponding tone generating substrate and a channel number of a corresponding tone generation channel of the corresponding tone generating substrate as well as corresponding performance information.

8. An electronic musical instrument as defined in claim 1, wherein, when receiving particular performance information, the channel assigner assigns the performance information to one of the tone generation channels of a tone generating substrate connected with particular one of the connection slots.

9. An electronic musical instrument comprising:

a plurality of tone generation boards each having a built-in tone generating circuit which has a plurality of tone generation channels each generating a tone signal in response to performance information input thereto;

a body into which the plurality of tone generation boards are inserted;

a channel detector detecting information of the tone generation channels of each tone generation board inserted into the body;

a memory, and a controller for establishing an assign table in the memory in response to the detected information, the assign table including performance information for each tone generation channel, wherein the performance information is assigned to one of the tone generation channels of the inserted tone generation boards in referring to the assign table.

* * * * *